United States Patent [19]

Givler

[11] Patent Number: 4,978,937

[45] Date of Patent: Dec. 18, 1990

[54] SPACER FOR THERMOSTAT STACK

[75] Inventor: Omar R. Givler, N. Canton, Ohio

[73] Assignee: Portage Electric Products, Inc., North Canton, Ohio

[21] Appl. No.: 445,396

[22] Filed: Dec. 4, 1989

[51] Int. Cl.[5] ..... H01H 37/04; H01H 37/52

[52] U.S. Cl. ..... 337/372; 337/380

[58] Field of Search ..... 337/372, 380, 112, 381

[56] References Cited

U.S. PATENT DOCUMENTS 4,335,368 6/1982 Givler ..... 337/372

4,374,372 2/1983 Givler ..... 337/372

*Primary Examiner*—H. Broome

*Attorney, Agent, or Firm*—Darby & Darby

[57] ABSTRACT

A thermostatic switch has a pair of contact strips separated by an insulative separator, with the separator and strips placed within a recess in a stacking block. The separator has a central portion and laterally extending tabs at the ends thereof, and reliefs formed at each inner corner formed by the junction of the central portion with a tab, such that the edges of the stacking block do not cause a stress concentration at the inner corners, avoiding breakage and current leakage through the separator.

7 Claims, 1 Drawing Sheet

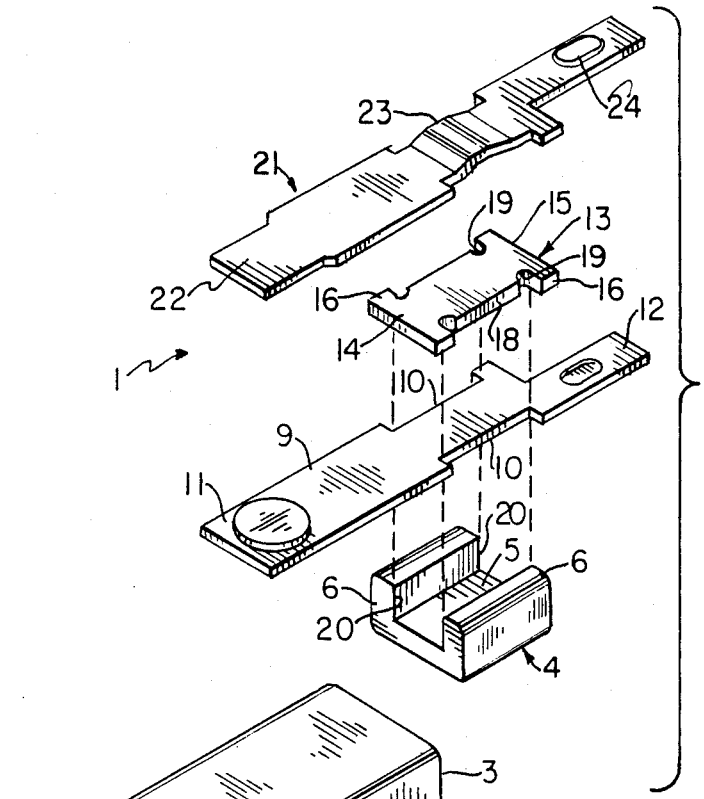
FIG. 1
FIG. 2
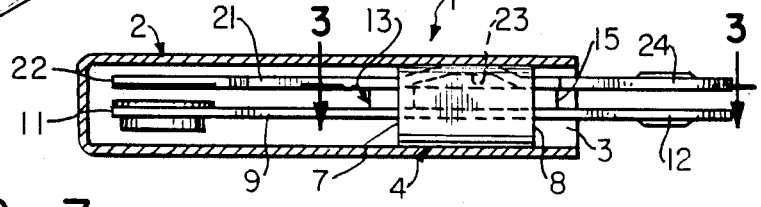
FIG. 3
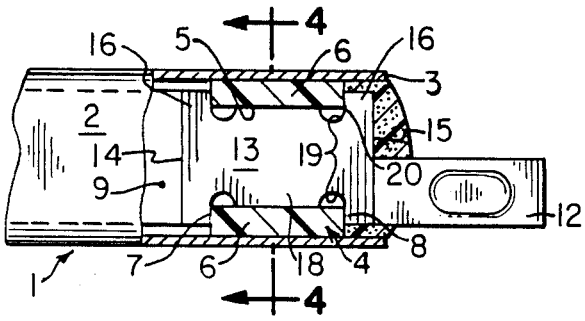
FIG. 4
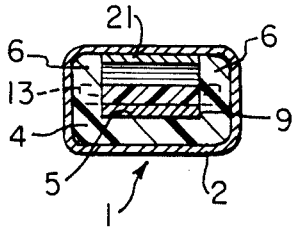

SPACER FOR THERMOSTAT STACK

TECHNICAL FIELD

This invention relates to improvements in thermostatic switches and more particularly to a thermostatic switch including a separator having corner reliefs.

BACKGROUND OF THE INVENTION

Many thermostatic switches are known which have contacts mounted on flexible strips with at least one of the flexible strips being formed of or biased by a bimetal material for movement subject to temperature variations. With such constructions, it is possible to provide relatively accurate electrical control responsive to temperature changes.

In U.S. Pat. No. 3,223,809 to Wehl, a thermostatic switch is disclosed which includes a stacking insulator block for stack-assembling a thermostatic switch. Generally, first and second contact strips are disposed within a recess in the stacking block and placed within a housing. An insulative separator is disposed between the two contact strips. The separator is shaped for retention in the stacking block, and may be either T- or I-shaped, having a central portion sized for placement in the stacking block recess, with extending end portions for limiting separator movement.

The insulative separator is generally composed of a ceramic powder which is shaped and then heated, with the separator typically being made of porcelain. Such a material is non-conducting and insensitive to temperature variations, but is subject to cracking under stress.

In forming the separator, it is difficult to achieve sharp edges on the inner corners of the T- or I-shaped ceramic insulator, due to the small size of the separator and the shrinkage properties of the ceramic material. If excess material is present in the corners, the inner corners of the ceramic separator may contact the edges of the stacking block, causing a stress concentration. Thus, the separator may crack, resulting in short-circuiting and switch failure. Consequently, the separators are typically produced with a narrowed center portion to assure that the inner corners clear the edges of the stacking block with a large safety margin. However, this narrowing weakens the central portion and causes the separator to float within the stack, which may also result in cracking with switch failure.

SUMMARY OF THE INVENTION

It is an object of the present invention to provide an insulative separator for placement between a pair of contact strips with the separator having relief means provided at the internal corners thereof to prevent breakage.

According to the present invention, a thermostatic switch has a casing, a stacking insulator block located within the casing, a first contact strip means having a portion sized for placement in a recess of the stacking block, an insulative separator having a central portion disposable within the stacking block recess overlaying the first contact strip means, second contact strip means having a portion sized for placement within the stacking block recess, overlaying the separator, the stacking block, separator, first and second contact strip means forming a switch assembly, the improvement comprising a plurality of relief means disposed at each inner corner of the separator central portion to prevent contact of the inner corners with the edges of the stacking block.

The relief means may comprise a plurality of indentations which may be molded or otherwise provided in the ceramic separator. These indentations limit contact between the inner corners of the separator and the edges of the stacking block and, therefore, preclude the possibility of cracking or breakage with a potential for short-circuiting and switch failure. Using such relief means, the central portion need not be excessively narrowed, increasing the strength of the separator and limiting separator movement.

BRIEF DESCRIPTION OF THE DRAWINGS

FIG. 1 is a perspective assembly view of the thermostatic switch of the present invention.

FIG. 2 is a sectional view of the fully assembled thermostatic switch with the insulative separator disposed therein.

FIG. 3 is a top sectional view of the assembly of FIG. 2 taken along the line 3—3.

FIG. 4 is a cross-sectional view of the assembly of FIG. 3 taken along the line 4—4.

DESCRIPTION OF THE PREFERRED EMBODIMENTS

Referring to FIG. 1, a thermostatic switch 1 is shown. The switch 1 includes a casing 2 having an open end 3 at one side thereof. A U-shaped stacking block 4, composed of an electrically insulating ceramic material such as porcelain, is used for assembling the switch components into a stack. A typical U-shaped stacking block is disclosed, for example, in U.S. Pat. No. 3,223,809 to Wehl, which is hereby incorporated by reference. Of course, stacking blocks with other shapes could also be used. The block 4 has a recess 5 between a pair of upright walls 6, a forward U-shaped surface 7 and a rearward U-shaped surface 8.

A first contact strip 9 has an indented portion 10 which is sized to mate with the recess 5. The contact strip also has a contact portion 11 and a lead end 12.

The switch 1 includes an insulative separator 13, having a forward end 14, and a rearward end 15, each end having a pair of laterally extending tabs 16. The tabs extend along the outside surfaces 7 and 8 of the stacking block, giving the separator an I-shaped configuration. The separator has a central portion 18 sized to be closely adjacent to the upright walls 6.

The insulative separator 13 includes reliefs 19 disposed at each mating surface between the central portion 18 and the tabs 16. Each relief is provided such that edges 20 of the stacking block 4 do not contact the inner corners of the separator, while the central portion 18 of the separator fits closely adjacent to the upright walls of the stacking block, to limit separator movement in the side directions, while the tabs 16, being closely adjacent to the forward and rearward outside surfaces 7 and 8, limit movement in the forward or rearward direction. Close spacing of the separator to the stacking block limits undesirable movement during switch operation. However, some spacing is necessary to prevent contact and breakage.

A second contact strip 21 is disposed above the separator 13, and has a contact portion 22, an indented portion 23, sized to be disposed in the stacking block recess 5, and a lead end 24. The indented portion is also bowed in an outward direction for contacting the casing 2 to spring load the stacked assembly.

The materials used for switch construction are those conventionally known in the field. The contact strips are formed from an electrically conductive metal such as brass, with the bimetal member either formed totally of a bimetal material or formed of a composite metal strip having bimetal layers formed on one side thereof. The contact portions are typically formed of a silver alloy. The casing may be made of brass, aluminum, steel or another metal, or, if a dead case type thermostatic switch, the casing may be made of a non-conducting material.

Referring to FIG. 2, the assembled thermostatic switch is shown. It should be noted that, while the assembly is restrained by the U-shaped stacking block 4 acting in combination with the bowed indented portion 23 of the second contact strip which engages the casing 2, numerous other thermostatic switch constructions could utilize the present invention. 1

Referring to FIG. 3, the insulative separator 13 has tabs 16 closely adjacent to the front and rear surfaces 7 and 8, respectively, of the stacking block 4. The central portion 18 is similarly closely adjacent to the upright walls 6, thus providing some rigidity of the assembly. While firmly retained, it should be noted that the edges of the U-shaped insulator do not engage the inner corners of the separator the to the provision of the relief means 19 at each inner corner thereof. Thus, a stress concentration, which could cause cracking or breakage of the separator upon insertion in the U-shaped insulator or during switch operation, is avoided. A cross-sectional view showing the placement of the separator 13 in the stack is shown in FIG. 4.

While an I-shaped separator is discussed, it will be understood by those skilled in the art that a T-shaped insulative separator could also benefit from the teaching of the present invention, having relief means at the two, rather than four inner corners. Also, while circular indentations at each inner corner of the insulator are shown, it will be understood that any other shaped reliefs may be provided so long as the reliefs avoid a stress concentration at the corners by limiting contact of the separator with an edge of the stacking block. These relief means are considered to include any elimination of material at the corners to prevent such contact. The relief means may be provided by molding to shape, drilling, milling or other operations. However, molding prior to firing is preferred.

While specific embodiments have been shown and described, the invention is not limited to these embodiments but is believed to encompass any embodiments which fall within the spirit and scope of the present invention.

I claim:

1. A thermostatic switch having at least one bimetal member responsive to temperature variations, a first contact movable in response to movement of the bimetallic member, a second member having a second contact adjacent to, and contactable with, the first contact, an insulative separator having a central portion and a plurality of tabs at ends thereof, placed between the first and second members, a plurality of inner corners formed at each junction of a tab with the central portion, a stacking block, having a recess sized for accepting placement of the first and second members and the central portion of the separator therein, the improvement comprising relief means provided at each inner corner of the separator, wherein said relief means limits contact between the inner corners of the separator and edges of the stacking block to avoid stress concentration which would cause breakage of the separator.

2. The thermostatic switch of claim 1 wherein the separator has an I-shape, with four tabs and wherein the relief means comprise four indents placed at the four inner corners of the separator.

3. The thermostatic switch of claim 1 wherein the separator has a T-shape with two tabs and wherein the relief means comprise two indents placed at the two inner corners of the separator.

4. A thermostatic switch including a casing having at least one open end and an upper case wall, a rigid, generally U-shaped stacking block which is disposable within the case open end, first contact strip means having an end portion sized for disposal within the U-shaped opening of the stacking block overlaying said first block, a rigid insulative separator having a plurality of tabs at ends thereof and which is sized for disposal within the U-shaped opening of the stacking block, overlaying the first contact strip means, inner corners provided at each tab, second contact strip means having a rearward portion which is sized for disposal within the U-shaped opening of the stacking block, overlaying the separator, at least one of the contact strip means being biased by a bimetallic strip for movement in response to a temperature variation, the improvement comprising relief means provided at each inner corner of the separator, wherein said relief means limits contact between the inner corners of the separator and edges of the stacking block to avoid stress concentration which would cause breakage of the separator.

5. The thermostatic switch of claim 4 wherein the separator has an I-shape with four tabs and wherein the relief means comprise four indents placed at the four inner corners of the I-shaped separator.

6. The thermostatic switch of claim 4 wherein the separator is T-shaped with two tabs and has indents provided at the two inside corners thereof.

7. A method for producing a thermostatic switch comprising: providing at least one bimetallic member responsive to temperature variations; providing a first contact movable in response to movement of the bimetallic member; providing a second member having a second contact adjacent to, and contactable with, the first contact; separating the contacts with an insulative separator having a central portion and a plurality of tabs at ends thereof; housing the first and second members and the separator in a U-shaped stacking block; providing relief means at each inner corner of the separator formed between the central portion and each tab, wherein said relief means limits contact between the inner corners of the separator and edges of the stacking block to avoid stress concentration which would cause breakage of the separator.

* * * * *